United States Patent [19]

Jansen

[11] Patent Number: 4,511,786

[45] Date of Patent: Apr. 16, 1985

[54] FORCED AIR DISTRIBUTOR FOR BASEBOARD HEATER

[75] Inventor: Friedrich W. Jansen, Prince George, Canada

[73] Assignee: P.J. Industrial Safety Elec. Co. Ltd., Prince George, Canada

[21] Appl. No.: 366,863

[22] Filed: Apr. 9, 1982

[51] Int. Cl.[3] ..... F24H 3/12; F24H 9/02; H05B 1/00

[52] U.S. Cl. ..... 219/364; 165/123; 219/367; 219/368; 219/370; 219/377

[58] Field of Search ..... 219/364, 365, 366, 369-371, 219/377, 367, 368; 165/123

[56] References Cited

U.S. PATENT DOCUMENTS

| | | | |
|---|---|---|---|
| 2,122,168 | 6/1938 | Woolley | 219/369 |
| 2,861,167 | 11/1958 | Wick | 219/365 |
| 2,863,978 | 12/1958 | Young | 219/365 |
| 2,988,626 | 6/1961 | Buttner | 219/364 |
| 3,071,677 | 1/1963 | Mast | 219/365 |
| 3,165,624 | 1/1965 | Cunningham | 219/365 |
| 3,267,255 | 8/1966 | Schulz | 219/370 |
| 3,283,125 | 11/1966 | Snelling | 219/365 |
| 3,335,319 | 8/1967 | Warner | 219/364 |
| 3,461,370 | 8/1969 | Canter | 219/364 |
| 3,469,177 | 9/1969 | Lorenz | 219/364 |
| 3,473,006 | 10/1969 | Barbier | 219/364 |
| 3,496,994 | 2/1970 | Cousins | 165/123 |
| 3,548,157 | 12/1970 | Lauck | 219/501 |
| 3,768,549 | 10/1973 | Goodie | 219/367 |
| 3,841,392 | 10/1974 | Osheroff | 165/123 |
| 4,302,663 | 11/1981 | Chesnut et al. | 219/371 |

FOREIGN PATENT DOCUMENTS

| | | | |
|---|---|---|---|
| 968872 | 9/1964 | United Kingdom | 219/369 |

*Primary Examiner*—Roy N. Envall, Jr.
*Assistant Examiner*—Geoffrey S. Evans
*Attorney, Agent, or Firm*—Beehler, Pavitt, Siegemund, Jagger & Martella

[57] ABSTRACT

A forced air distributor for supplying air to an air intake of a baseboard heater which includes a duct assembly enclosing an elongated air passageway and an elongated discharge orifice along the upper portion of the air passageway adjacent to the air intake of the heater element. Air flow is directed into an open end of the air passageway by air pump means. A preheater filament element longitudinally disposed in the air passageway preheats in flowing air to compensate for the pressure drop along the air passageway so that a uniform flow of heated air flows out through the orifice.

6 Claims, 4 Drawing Figures

FILAMENT HEATING ELEMENT

FORCED AIR DISTRIBUTOR FOR BASEBOARD HEATER

FIELD OF THE INVENTION

The present invention relates to a forced air distributor and associated heater power control for supplying a portion of the intake air of a baseboard heater and to control the power supplied to the baseboard heater element.

DESCRIPTION OF THE PRIOR ART

Most baseboard heaters are of the non-forced air type relying on convection to obtain air circulation. Upon heat demand established by internal and/or external thermostat sensing units, energy is supplied to the heating elements. As the heating elements increase in temperature, the temperature of air surrounding them is elevated and thus caused to rise up through the heating elements thereby further increasing in temperature as well as velocity. The heated air is exhausted through the baseboard heater at a greatly increased temperature and subsequently mixes with and transfers heat to surrounding cooler air. The foregoing process continues until a predetermined temperature has been reached at which time the supply of energy to the heating elements is terminated. During the heating process as the surrounding room air increases in temperature, air enters the baseboard heater at a continuously decreasing velocity thus reducing the heater efficiency. In the limit of air approaching the temperature of the surface of the heating elements, the velocity of air entering the baseboard heater approaches nil.

Attempts have been made in the past to increase baseboard heater efficiency by providing a source of forced air from a motorized fan or air blower usually located at one end of the baseboard assembly. Such arrangements typically utilized a duct which conducted forced air lengthwise along the bottom of the baseboard assembly where it entered the baseboard heater element region for subsequent heating and discharge to a room. In U.S. Pat. No. 3,267,255 issued to A. E. Schulz on Aug. 16, 1966, forced air was blown into an elongated duct of rectangular cross section in which there was mounted an electrical filament. By permitting escape of the air enclosed by the duct only through spaced holes of a predetermined diameter along the face of the duct, it is stated that a relatively uniform flow of heated air was obtained along the length of the duct. One disadvantage in the latter system is that the size and spacing of the holes in order to achieve the desired air distribution is highly dependent on the air output of the fan as well as on the length of the duct. Moreover, in the event of a failure of the fan the heater becomes inoperative and without provision for discontinuing heater current thus creating a fire hazard.

Other attempts have utilized an elongated air duct operating as a plenum chamber below the air heating elements. In U.S. Pat. No. 2,988,626, issued to C. M. Buttner on June 13, 1961 air is blown through one end of an elongated duct and portions thereof selectively directed upwardly through predetermined lengthwise sections of the filament by means of a series of spaced downwardly extending baffles. The baffles nearer to the source of forced air extend downwardly a shorter distance than those further removed from the source of forced air. The Buttner device utilizes only forced air and, consequently, in the event of failure of the fan, the device is inoperative and as a consequence, becomes overheated thereby creating a fire hazard. Moreover, the proper apportioning of air to the individual lengthwise sections of the filament depends greatly on the proper mounting alignment of the fan. The apportioning of air in the latter system as a natural consequence of the technique employed is only approximate and depends on the spatial distribution of air emitted by the output of the fan. In U.S. Pat. No. 3,473,006 issued to Barbier on Oct. 14, 1969 forced air was introduced into one end of an elongated rectangular duct located below a plurality of elongated heater coils. The top surface of the duct contains a plurality of spaced perforations or air flow ports arranged in rows. Between the rows at intervals along the length of the underside of the top plenum surface there are secured a plurality of transverse baffles or angles which project downwardly a small portion of the depth of the plenum chamber or duct. The required depth of each baffle is determined by experiment as that being sufficient to convert the longitudinally flowing air into static pressure at the ports and, thus, substantially equalize the flow through the air flow ports along the length of the chamber. The relatively complicated baffle system in the Barbier device leads to a drop in air discharge pressure as distance from the fan increases, thus reducing the rate of discharge of air through the associated air flow ports with increasing distance away from the fan.

A common disadvantage in all of the previous systems mentioned is that they require the entire unit be custom built to in affect, replace the conventional baseboard heaters. Moreover, a change in length of the foregoing units necessitates a change in design of the air holes.

Additionally, none of the foregoing devices utilizes a means of controlling power to the filament so that power dissipation in the filament may be reduced when average heat production requirements are lowered as for example, when a space to be heated is at or near a selected desired temperature level. Desirably such control should not be accomplished by introducing long gaps between ON and OFF cycling of the heater element in order to avoid noticeable cooling of the aforesaid space.

SUMMARY OF THE INVENTION

According to the present invention, there is provided a forced air distributor for supplying air to the air intake at the lower side base of a conventional base board heater. The distributor includes a duct assembly which encloses an elongated air passageway having an opening at one end and an elongated discharge orifice along an upper side portion thereof for positioning adjacent to the air intake of the heater. The positioning is such that both air from the air discharge orifice and aspirated air from a room being heated by the baseboard heater can flow simultaneously into the air intake of the latter. The distributor further includes air pump means for providing air flow into the open end of the duct assembly and a mesh baffle covering said air passageway at a preselected distance from an open end thereof.

The distributor may further, comprise an elongated air deflector disposed along an edge of to the discharge orifice for directing air flow upwardly into the air intake of the base board heater. As well, the distributor further usefully can additionally comprise a preheater means longitudinally disposed in the duct assembly for preheating the air in the air passageway, so that the pressure drop from the air flowing along the air passageway, is offset by the pressure increase in air due to the preheating.

By including electrical energy control means to reduce or increase concurrently the electrical energy supplied to both the air pump means and the preheater means in response to a control signal from a manually operable external control setting, optimum adjustment of the energy applied to the heater may be obtained. At the same time an appropriate adjustment of the fan motor speed is effected by a reduction or increase in electrical energy supplied to the air pump means corresponding to the reduction or increase, respectively, in heater energy being supplied. By utilizing a heater filament element having a large heat capacity, heat stored in the heater may be scavenged during the OFF cycle with a minimum of cooling of the heater element.

Preferably the duct assembly encloses a pair of adjacent elongated air passageways extending from an open end thereof a preselected distance to a terminal and a single elongated air passageway of a cross sectional area substantially equal to the combined cross sectional areas of said pair of air passageways. The single passageway extends from the terminal end to a closed end of the duct assembly. The elongate discharge orifice extends along the upper side of an inner one of said pair of passageways remote from a room wall and along the upper side of the single air passageway. The elongated filament is mounted within the inner air passageway.

The force air distributor may be constructed so that it is adapted to be fitted to the bottom of a conventional baseboard heater thereby avoiding the need to replace the entire existing baseboard heater and hence reducing the cost of the improvement. Moreover, provision of a removable closure member facilitates extension of a given distributor by fitting to the end of such distributor a further distributor section.

The present system also features a capability to operate by convection air alone so that failure of the fan does not result in a total failure of the baseboard heater unit nor does such a failure create a fire hazard.

In another aspect of the invention there is provided a baseboard forced air heater comprising a baseboard heater having an air intake, air heater surfaces and a heated air output orifice. The heater also includes a forced air distributor mounted below the baseboard heater and adjacent to the air intake of the latter. The distributor includes a housing enclosing an elongated air passageway having an opening at one end and an elongated discharge orifice along an upper side thereof for positioning adjacent to the air intake of the heater. The latter positioning is effected so that both air from the air passageway and air from a room being heated by the baseboard heater flow into the air intake of the latter. The distributor further includes air pump means for providing air flow into the open end of the housing and preheater means longitudinally disposed in the housing for preheating the air in the air passageway. The preheating ensures that the pressure drop from air flowing along the air passageway is offset by the pressure increase in air due to the preheating.

Preferably, the baseboard forced air heater includes an elongated air deflector disposed along one edge of the discharge orifice of the distributor for directing air flow into the air intake of the heater.

By discharging air from the output of the baseboard heater at a small angle with respect to the horizontal rapid mixing with the surrounding air is obtained thereby promoting faster heat exchange and a more efficient heating effect.

A convenient method of controlling the energy supplied both to the heat elements and to the fan is the utilization of phase control power. In combination with the latter, a conventional thermostat is used to control heat output in accordance with a preset temperature condition.

Employing phase control of the energy supply to both the heat elements and to the air pump means, a reduced on and off cycling by the thermostat can be obtained thereby reducing heat cycling of the heater filament elements. The latter reduction provides more efficient operation by avoiding the energy wasted in heating up and cooling off the heater elements.

BRIEF DESCRIPTION OF THE DRAWINGS

Aspects of the invention are illustrated, merely by way of example, in the accompanying drawings, in which.

In the foregoing description words such as upper, lower, inner and outer are used in a relative sense only rather than in an absolute sense. In the different figures like reference numbers refer to the same elements.

DESCRIPTION OF THE PREFERRED EMBODIMENTS

Figure 1:
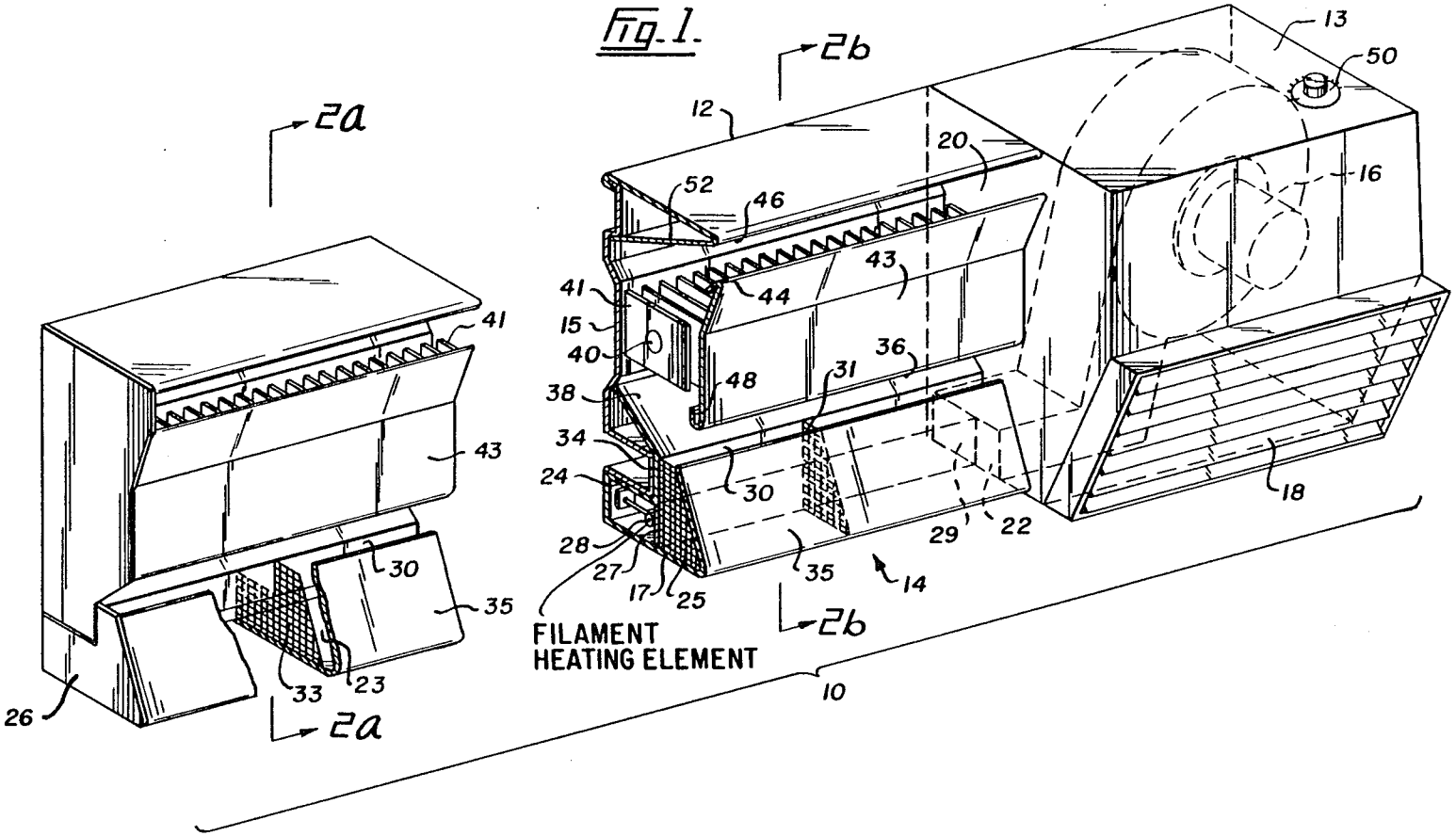
FIG. 1 is a perspective view of the forced air baseboard heater according to the invention with a portion of the heater cut away, FIG. *2a* is an end view of a section through the heater along line *2a—2a,* illustrated in FIG. 1, and FIG. *2b* is an end view of a section through the heater along line *2b—2b,* illustrated in FIG. 1.
Figure 2A:
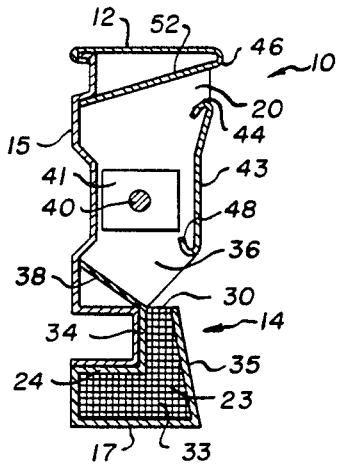
Figure 2B:
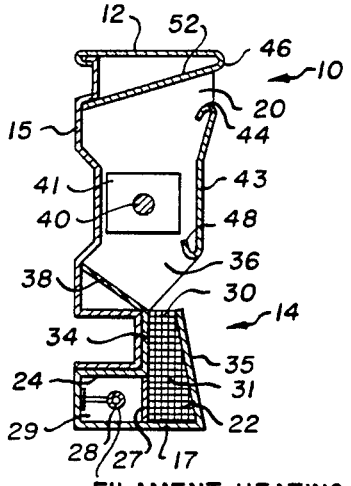

FIG. 1 illustrates in perspective a preferred embodiment of the forced air distributor 10 used in conjunction with a conventional baseboard heater 12. The distributor 10 includes at one end a fan and motor 16 housed within a fan and motor housing 13. The distributor 10 also includes a duct assembly 14 located directly beneath the baseboard heater 12. The forced air baseboard heater 10 has a face 15 (see FIG. 2) for mounting to the wall of a room (not shown). The duct assembly 14 has a bottom surface 17 for mounting on or near the floor of the room (not shown). A fan and motor housing 13, which encloses the air pump means or motor and fan 16, includes a plurality of louvered apertures forming an air entranceway 18. Optionally, the air entranceway 18 may include a filter (not shown) to eliminate dust particles from circulation into the baseboard heater 10. A discharge opening 20 of the fan communicates with a pair of adjacent air passageways 22 and 29 of the duct assembly 14. The air passageways 22 and 29 extend to the center of the duct assembly 14 and are separated by a divider partition 27. Half way along the duct assembly 14 the partition 27 ends and the two air passageways merge to form a single air passageway 23. At one quarter and one half the length of the duct assembly there is located mesh 31 covering the air passageway 22. Half way along the second half of the duct assembly 14 there is a mesh 33 covering the air passageway 23. The end of air passageway 23 is sealed closed by a removable end cap 26. Mounted in a longitudinally extending position in the air passageway 29 is an elongated preheater filament element 28 used to preheat air contained therein. Along a longitudinally extending upper outer edge of the air passageways 22 and 23 formed by vertical bend 34 in the upper surface 24 and a spaced apart upwardly extended portion of the outer face 35 is an elongated discharge orifice 30 for directing air from within the elongated air passageways 22 and 23 upwardly in a substantially vertical direction along the entire length of the duct assembly 14. The inner edge of the discharge orifice 30 extends beyond the orifice at an acute angle to the vertical forming an air deflector 38. The duct assembly 14 is dimensioned to fit immediately under the bottom of the baseboard heater 12 with the discharge orifice 30 of the duct assembly 14 adjacent to and communicating with an air entranceway 36 of the baseboard heater 12. The air deflector 38 of the duct assembly 14 sits inside the air entranceway 36 of the baseboard heater 12 to provide a smooth non-turbulent movement of air into the air entranceway 36 of the baseboard heater 12. The baseboard heater 12 has an additional air deflector or baffle 48 at the air entranceway 36 adjacent to the outer face 43 of the heater 12. An elongated heater element 40 is mounted along the length of the heater 12 directly in the path of incoming air from the air entranceway 36. The surface area of the heat element 40 is increased by a plurality of thermal conductive fins 41 spaced along the heat element 40 and in thermal contact therewith. Above the heat element 40 there is formed an air discharge opening 20 defined by the outer edges 46 and 44 of an exhaust air deflector plate 52 and outer side plate 43, respectively. The exhaust air deflector plate 52 is inclined downwardly at a slight angle to the horizontal from the upper edge 46 of the exhaust port 20.

The fan and motor housing 13 contains a control dial 50 for adjusting the amount of electrical energy supplied to both the fan and motor 16. Control of the electrical energy applied to the heater element 40 and to the fan and motor 16 and preheater element 28 is obtained by phase control of the voltage and current supplied to the latter elements. The phase control circuits used for this purpose shown in FIG. 3 are also housed in the fan and motor housing 13.

Figure 3:
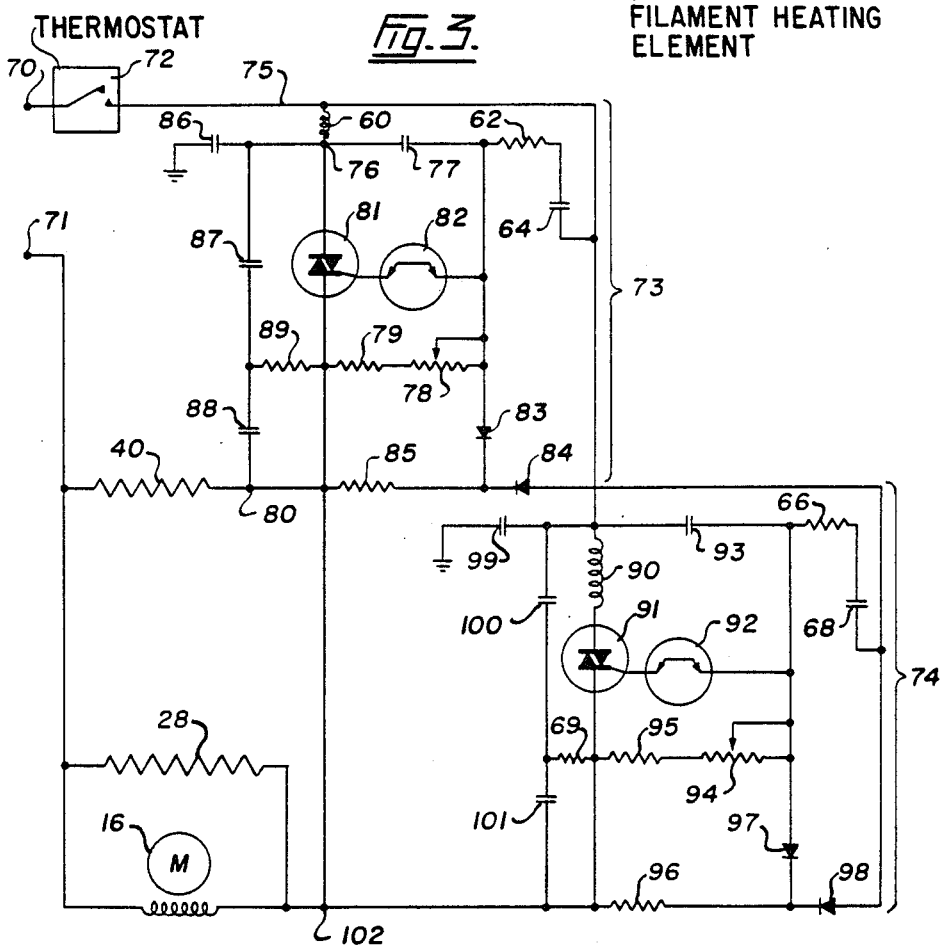
FIG. 3 is a schematic diagram of the electronic power supply circuit used to control power to the baseboard heat element and also to the preheater filament and the fan motor.

A 240 volt alterating current line voltage is applied across the input terminals 70 and 71 of the circuit of FIG. 3 and through a thermostat 72 to each of two phase control circuits 73 and 74. A first phase control circuit 73 controls the power applied to a baseboard heat element 40 indicated as a resistive element. A second phase control circuit 74 controls power to the preheater filament element 28 indicated as resistive and to the fan motor 16 which is inductive.

Terminal 76 of circuit 73 is connected to the thermostat controlled line 75 through an inductor 60. AC current is provided via line 75 and inductor 60 to capacitor 77, the latter being coupled to terminal 76 on one side and to variable resistor 78 on the other side. Resistor 79 is connected in series with the variable resistor 78, the combination being coupled to terminal 80 to which is connected the baseboard heater element 40.

A bi-directional thyristor 80 is connected between terminal 76 and terminal 80 leading to the baseboard heater element. A bi-directional diode (diac) 82 is connected between the gate of the thyristor 81 and the junction of capacitor 77 and the variable resistor 78. Also connected to the latter junction is the anode of diode 83. The cathode of diode 83 is connected through a resistor 85 to terminal 80. The cathode of a second diode 84 is connected to the junction or resistor 85 and diode 83 and its anode to line 75. Capacitors 86, 87 and 88 are connected in series 80 with one end of capacitor 86 connected to ground and an end of the capacitor 88, being the opposite end of the series connected capacitors, connected to terminal 80. The junction of capacitors 86 and 87 is connected to terminal 76 and the junction of capacitor 87 and 88 is connected to one terminal of a resistor 89. The other terminal of resistor 89 is connected to terminal 80. To the junction of capacitor 77 and diac 82 is coupled a resistor 62 in series with a capacitor 64.

When the contacts of thermostat 72 close due to room temperature falling below a pre set level, AC voltage is applied across circuit 73. As the voltage increases (either positively or negatively) from zero, capacitor 77 charges up through inductor 60, resistors 78 and 79 and heater filament element 40. When the voltage across capacitor 77 reaches the breakdown voltage of diac 82, the latter conducts current into the gate of thyristor 81. Thus, thyristor 81 is turned to an ON or conducting state allowing line voltage to be applied to the baseboard heater element 40. When the line voltage reverses thyristor 81 turns off and capacitor 77 charges up in the opposite direction through inductor 60, resistors 78 and 79 and heater filament element 40. By adjusting the resistance of variable resistor 78 the angle at which thyristor 81 conducts on each half cycle may be varied from 0° to 90° corresponding to energy being supplied to the heater over each full half cycle (100% ON) to only one-half of each half cycle (50% ON). Capacitors 86, 87 and 88 and resistor 89 filter AM radio frequency noise. Diodes 83 and 84 and resistor 85 eliminate the sudden 'SNAP ON' of the thyristor by rapid discharge of capacitor 77 into diac 82. Resistor 62 in series with capacitor 64 limit the rate of rise of voltage across Triac 81 to a safe limit.

Circuit 74 is substantially the same as circuit 73 except that choke 90 which is in series with thyristor 91 compensates for the inductive effect of the fan motor which is of the "shaded pole" type and also filters switching noise caused by the thyristor. Variable resistors 78 and 94 are ganged together and operated by a single control to provide variation of the conduction angle of each thyristor 81 and 91 concurrently. As with circuit 73, capacitor 93 and resistors 94 and 95 determine the charging time constant of capacity 93. Diodes 97 and 98 and resistor 96 control 'snap-on' of diac 92. Capacitors 99, 100 and 101 eliminate radio frequency interference. The preheater filament resistance 28 is in parallel with the inductance of the fan motor 16. Resistof 66 in series with capacitor 68 couples the junction of capacitor 93 to line 75 and the combination operates to limit the rate of rise of voltage across triac 81.

In operation, the fan 16 takes in room air through the air entranceway 18 and directs the latter out of the fan discharge opening 20 to the elongated air passageways 22 and 29. Air from the fan 16 is blown down the elongated air passageways 22 and 29 and air flowing along air passageway 29 is heated by the preheater element 28 as it travels along the length of the elongated air passageway 29. The preheating of the air compensates for the loss of pressure of air travelling along the air passageway 29 which drop increases with increasing distance from the open end of the air passageway 29. Compensation arises from the fact that a given volume of air undergoes an amount of heating proportional to its distance of travel along the air passageway 29.

Turbulence in air flow flowing along air passageway 22 is created by mesh baffles 31 and 25 which causes a more even air discharge along the length of orifice 30. The absence of baffles along the first half of the duct assembly 14 in duct 29 augments the air flow into the second half 23 of the duct assembly 14 relative to that through air passageway 22. Mesh baffle 33 causes turbulence in air flowing along air passageway 23 which results in a more uniform air flow along the length of orifice 30 in the second half 23 of the duct assembly 14.

By heating air within the air passageway 29 by an amount approximately proportional to the distance away from the open end, an expansion of the latter air is obtained and a discharge through the air orifice 30 at a higher velocity than would otherwise be achieved results. The higher discharge velocity causes the aspiration of a greater than otherwise volume of air from the room into the air entranceway 36 of the heater 12.

Air within air passageway 22 and heated air within the air passageways 23 rises travelling out the discharge orifice 30 into the air entranceway 36 of the baseboard heater 12. Aspirated room air also enters the air entranceway 36 where it mixes with the air from the duct assembly 14 and travels upwardly through the fins 41 of the heat elements 40. The air deflector 38 and air intake baffle 48 ensure the smooth undisturbed introduction of air into the baseboard heater 12. Upon passing through the fins 41 within the baseboard heater 12 upwardly rising air undergoes further heating and thereby acquires an increased velocity prior to discharge of the latter through the air discharge opening 20. The air exhaust deflector 52 deflects the heated air at a substantial angle from the vertical in order to promote a more thorough mixing with the surrounding room air. Thus a faster heating of the room is obtained than would result if the heated air where allowed to simply rise vertically. The end cap 26 of the duct assembly 14 is removable to permit connection of an additional length of forced air distributor where required.

With conventional systems a thermostat (not shown) controls the supply of electrical energy to the heater element 40 and to the preheater filament 28 and fan and motor 16. A separate phase control circuit is used to control power applied to the baseboard heater 12 from that used to control power applied to both the fan and motor 16 and to the preheater filament element 28. However, the variable resistive elements 78 and 94 which control the angle of conduction for each of the phase control circuits are ganged together so that a single adjustment can reversibly change the power applied to the heater element 40 from 50% to 100% of full power and that supplied to the preheater element 28 and fan and motor 16 also from 50% to 100%. Thus a reduced or increased amount of heating of the heat element 40 is coupled with a reduced or increased amount, respectively, of heating of the preheater filament 28 and a corresponding reduction or increase, respectively, in fan speed. Thus the rate of air flow through the system is matched with the amount of heat energy supplied to the heater element 40 and filament 28. It is possible to reduce the amount of electrical energy consumed during long cycles of the baseboard heater by a manual adjustment once the room temperature has been brought up near to the preset temperature level of the thermostat (not shown) thereby increasing the efficiency of the unit. Moreover, by increasing the volume of air passed through the system within a given time more rapid heating of the room is obtained for a given amount of electrical energy expended resulting in a significant increase in efficiency of the unit.

To obtain optimum operation of the phase control of filament current through the heater filament 40, the latter must have a sufficient heat capacity to be able to store and provide heat during the OFF cycles of the triac 81.

Other departures, variations and modifications that do not depart from the spirit of the invention or the scope thereof as defined in the appended claims will be obvious to those skilled in the art.

I claim:

1. A forced air distributor for supplying air to the air intake of a baseboard heater, the air intake being an elongated slot in the lower side of the baseboard heater, which distributor comprises:

(a) a duct assembly enclosing a pair of adjacent elongated air passageways comprising an inner air passageway and an outer air passageway extending from an open end thereof a preselected distance to a terminal end, and a single elongated air passageway of a cross sectional area substantially equal to the combined cross sectional area of said pair of air passageways extending from said terminal end to a closed end of said assembly, said duct assembly further having an elongated air discharge orifice along an upper longitudinally extending side thereof, communicating with an outer one of the pair of air passageways and the single air passageway;

(b) a mesh baffle positioned at about half way along the length of said outer air passageway and a further mesh baffle at the end of said outer air passageway each baffle extending over the cross sectional area of said outer air passageway and a further mesh baffle at about half way along the length of the single elongated air passageway and extending over the cross sectional area of said single elongated air passageway;

(c) air pump means for supplying air under superatmospheric pressure into the open end of said duct assembly in response to electrical current provided by an external source of electrical energy; and (d) an elongated air deflector mounted on said duct assembly along an edge of said discharge orifice closest to a wall mounting surface of said assembly and generally inclined to lie in a direction of air flow into the air intake of said baseboard heater.

2. A forced air distributor as defined in claim 1, further comprising:

electrical energy control means for adjusting concurrently the amount of electrical current supplied to both a heater element of said baseboard heater and said air pump means such that heating of said baseboard heater and rate of air flow supplied by said air pump means are both reduced or increased in response to a corresponding reduction or increase in the amount of said electrical current supplied.

3. A forced air distributor as defined in claim 1, additionally comprising an elongated filament mounted within said inner air passageway for preheating air therein in response to the flow of an electric current therethrough such that the pressure drop from air flowing along said inner air passageway may be offset by the pressure increase due to preheating of the air by said preheater means.

4. A forced air distributor as defined in claim 1 in which the length of said pair of air passageways is equal to the length of said single air passageway.

5. A baseboard forced air heater comprising:

(a) a baseboard heater having an air intake in the form of an elongated slot in a lower side thereof, air heating surfaces and a heated air exhaust port;

(b) a forced air distributor mounted below said baseboard heater adjacent the air intake, said distributor including;

(c) a duct assembly enclosing a pair of adjacent elongated air passageways comprising an inner air passageway and an outer air passageway extending from an open end thereof a preselected distance to a terminal end, and a single elongated air passageway of a cross sectional area substantially equal to the combined cross sectional area of said pair of air passageways extending from said terminal end to a closed end of said assembly, said duct assembly further having an elongated air discharge orifice along an upper longitudinally extending side thereof, communicating with an outer one of the pair of air passageways and the single air passageway;

(d) a mesh baffle positioned at about half way along the length of said outer air passageway and a further mesh baffle at the end of said outer air passageway each baffle extending over the cross sectional area of said outer air passageway and a further mesh baffle at about half way along the length of the single elongated air passageway and extending over the cross sectional area of said single elongated air passageway;

(e) air pump means for supplying air under superatmospheric pressure into the open end of said duct assembly in response to electrical current provided by an external source of electrical energy; and (f) an elongated air deflector mounted on said duct assembly along an edge of said discharge orifice closest to a wall mounting surface of said assembly and generally inclined to lie in a direction of air flow into the air intake of said baseboard heater.

6. A baseboard forced air heater as defined in claim 5, wherein said distributor further includes:

preheater means longitudinally disposed in said duct assembly for preheating the air so that the pressure drop from air flowing along the air passageway is offset by the pressure increase in air due to the preheating.

* * * * *